US006780116B2

(12) United States Patent
Hurst et al.

(10) Patent No.: US 6,780,116 B2
(45) Date of Patent: Aug. 24, 2004

(54) WEAR RESISTANT NAIL MANUFACTURING TOOL INSERTS

(75) Inventors: Joe L. Hurst, Rogers, AR (US); Michael P. Kimmel, Rogers, AR (US)

(73) Assignee: Kennametal Inc., Latrobe, PA (US)

( * ) Notice: Subject to any disclaimer, the term of this patent is extended or adjusted under 35 U.S.C. 154(b) by 18 days.

(21) Appl. No.: 09/928,376

(22) Filed: Aug. 13, 2001

(65) Prior Publication Data

US 2003/0032489 A1 Feb. 13, 2003

(51) Int. Cl.[7] ..... B21G 3/00

(52) U.S. Cl. ..... 470/156; 470/121; 470/192; 470/195

(58) Field of Search ..... 470/110, 114, 470/121, 125, 126, 127, 141, 146, 156, 160, 183, 192, 195; 407/113, 114

(56) References Cited

U.S. PATENT DOCUMENTS

| | | | | | |
|---|---|---|---|---|---|
| 372,844 | A | | 11/1887 | Emerson et al. | |
| 2,115,544 | A | | 4/1938 | Werner | 10/53 |
| 2,178,711 | A | * | 11/1939 | Werner | 470/125 |
| 2,381,171 | A | | 8/1945 | Little et al. | 10/43 |
| 2,527,759 | A | | 10/1950 | Pierson | 10/49 |
| 2,652,577 | A | | 9/1953 | Chiaberta | 10/2 |
| 3,109,187 | A | | 11/1963 | Pirc | 10/43 |
| 3,398,413 | A | | 8/1968 | Skierski | 10/9 |
| 3,604,034 | A | | 9/1971 | Leistner | 10/46 |
| 3,643,309 | A | * | 2/1972 | Anschutz | 407/66 |
| 4,150,451 | A | | 4/1979 | Skierski | 10/9 |
| 4,572,713 | A | * | 2/1986 | Schmidt | 407/114 |
| 4,674,924 | A | * | 6/1987 | Carlsson et al. | 407/114 |
| 5,067,858 | A | * | 11/1991 | Cook | 407/114 |
| 5,195,931 | A | | 3/1993 | Wright et al. | 470/40 |
| 5,880,382 | A | | 3/1999 | Fang et al. | 75/236 |
| 5,979,216 | A | | 11/1999 | Schretter et al. | 72/478 |
| 6,050,751 | A | * | 4/2000 | Hellstrom | 407/104 |
| 6,196,771 | B1 | * | 3/2001 | Andersson | 407/113 |

FOREIGN PATENT DOCUMENTS

| | | | | |
|---|---|---|---|---|
| DE | 3129451 | | 2/1983 | |
| EP | 0401918 | | 12/1990 | |
| EP | 04066202 | | 1/1991 | |
| EP | 0504995 | | 9/1992 | |
| GB | 2034223 | * | 6/1980 | 470/110 |
| JP | 55065004 | | 5/1980 | |
| JP | 11188447 | | 7/1999 | |

OTHER PUBLICATIONS

Power Point Presentation of Martin Marietta Inc. in Deluth, Georgia on Mar. 22, 2001.

PCT Search Report mailed Oct. 15, 2002, in counterpart application PCT/US02/23585, filed Jul. 25, 2002.

* cited by examiner

*Primary Examiner*—Ed Tolan
(74) *Attorney, Agent, or Firm*—John J. Prizzi

(57) ABSTRACT

A clamping jaw assembly and cutter assembly employed in machinery used to manufacture nails, screws, rivets, and similar objects starting with wire material. The invention includes a groove design having a smooth wave that reduces the wear rate of the groove improving the life expectancy of the hard material clamping jaw insert. A clamping jaw assembly and cutting assembly that are both easily accessible for permitting quick replacement and/or indexing of the carbide-clamping inserts.

8 Claims, 4 Drawing Sheets

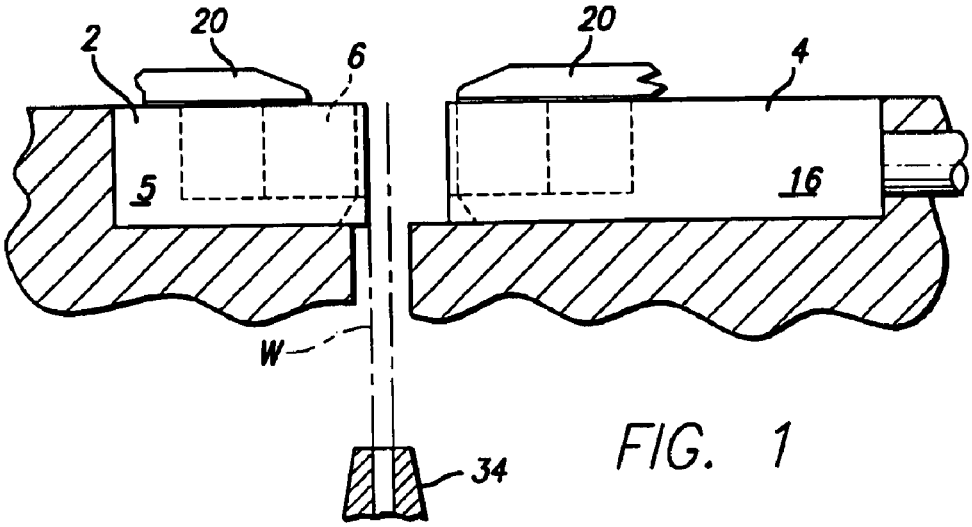
FIG. 1
FIG. 2
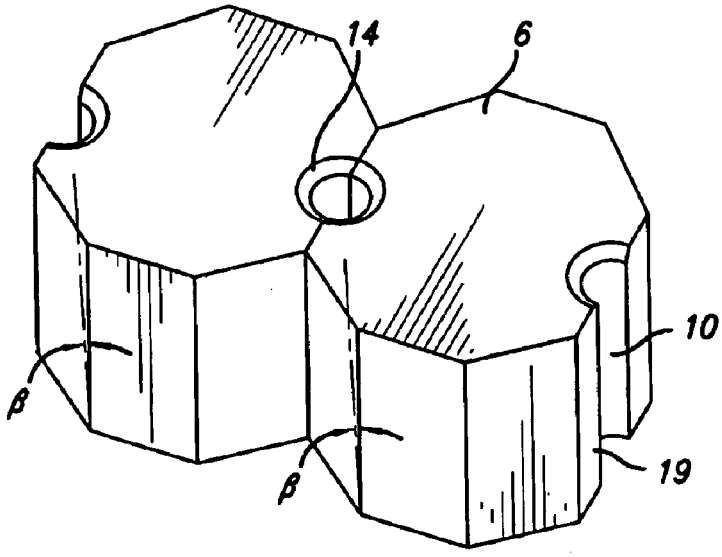

WEAR RESISTANT NAIL MANUFACTURING TOOL INSERTS

FIELD OF THE INVENTION

This invention pertains to a wear-resistant tool insert for machines used in the production of nails, screws, rivets, and similar objects starting with wire material.

BACKGROUND OF THE INVENTION

Nails are produced by feeding wire to a clamping punch and cutter. The clamping jaws hold the wire stock in position while the cutter shapes the nail point and the punch shapes the nailhead. Currently, nail-manufacturing machines having reciprocating clamping jaws can produce approximately 600 nails a minute. Nail machines, as in prior art designs, include grippers/clamping jaws and cutters that were made from conventional steel U.S. Pat. No. 5,195,931.

More recently, clamping jaws have been made to include inserts made from hard wear-resistant material, such as cemented tungsten carbide as shown in U.S. Pat. No. 5,979,216.

DESCRIPTION OF RELATED ART

Wear-resistant tool inserts of this type are employed in pairs in nail manufacturing machines and are called impact or clamping jaws and pincer jaws. The clamping jaws are often used as replaceable parts in toolholders. The clamping jaws have elongated, prism-like trapezoidal cross-section base elements corresponding to similar recesses in the toolholders. One working surface of the clamping jaws has one or more clamping grooves for tightly clamping the supplied wire and also a recess for forming the desired head shape of the object to be produced. The clamping jaws are arranged in the machine so that the clamping grooves are located opposite each other. In the course of the machine operation, the clamping jaws are closed or opened. In the closed state, the supplied wire is tightly clamped in the clamping grooves. In the clamped state, the head of the nail, screw or rivet is formed. For better clamping of the supplied wire, the clamping grooves are preferably transverse and semicircular in form.

After completion of the head, the nail point is elongated by closing two opposing pincer jaws. The pincer jaws are clamped tightly in machine toolholders or attached directly in the machine. The pincer jaws have a symmetrical profile with several cuts where the end of the finished point is shaped and the point is elongated.

A prior art damper jaw body with a hard material insert is depicted in European Patent 401,918 B1 by Michael Schratter which was filed on Jun. 5, 1990. The clamping insert wire holding groove 5, as shown in the drawings, has a plurality of serrations for better clasping the wire. As can best be seen in FIG. 1 of the European patent, a screw 4 is employed to clamp the insert 2 to the clamp jaw body.

The tool inserts are often manufactured of hard metal to reduce wear. If the wear on the clamping grooves or on the cutters is excessive, then the inserts must be replaced. Replacement of hard material inserts requires downtime, increasing equipment costs, and reduces profits.

SUMMARY OF THE INVENTION

It is, therefore, an object of this invention to address the problem of creating wear-resistant tool inserts for machines for the manufacture of nails, screws, rivets, and such.

It is another object of this invention that hard metal is used as a particularly favorable material for the tool inserts—the hardness being of at least 1,500 (HV30)—as measured in a Vickers test.

The invention introduces a new groove design having a smooth wave that reduces the wear rate of the groove improving the life expectancy of the hard material clamping insert.

Another object of the invention is to design a clamping jaw that is easily accessible for permitting replacement and/or indexing of the carbide-clamping insert.

This invention is further described in reference to the figures. It will be understood by those of ordinary skill that the embodiments described and illustrated serve as examples of this invention and that other embodiments will similarly accomplish the same objectives. Though not specifically illustrated or described in this specification, it is further intended and understood that all other embodiments, accomplishing the same objectives, are intended to be covered and claimed in this application.

BRIEF DESCRIPTION OF THE DRAWINGS

FIG. 1 illustrates the nail die assembly for making nails.

FIG. 2 discloses the cooperation of the hard clamping insert when the clamping jaws are shut.

DETAILED DESCRIPTION OF THE INVENTION

Figure 3A:
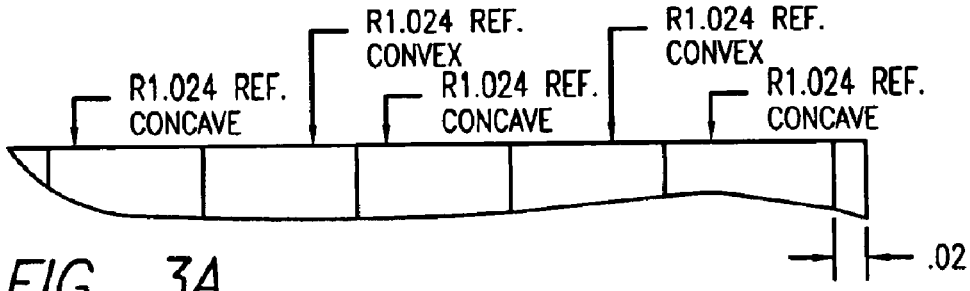
FIG. 3A illustrates an enlarged detail section of the exterior wall of the EDM tool shown in FIG. 3.

FIG. 1 shows a nail impact jaw consisting of a fixed elongated die 2 and a movable die 4 transversely toward and away from the die 2. The body 2 includes a body portion 5 made of tool steel with a tungsten carbide clamping insert 6 therein at the end facing die 4. The clamping insert according to this embodiment of the present invention is octagonal and clamped in a recess of the base element and easily removed from said recess. A cavity for the clamping insert is installed in the middle of body 2 in a longitudinal direction. The clamping insert 6 can be tightly clamped in the recess with a wedge 7.

The wire is fed to the dies by a conventional wire feeder 34. In FIG. 1, the wire is shown as being fed vertically upward. However, it should be understood that the direction of feed has nothing to do with the present invention.

At least one of the sides of each clamping insert has a contact face 19 with generally semi-cylindrical groove 10. The contact face is otherwise planar and oriented which is perpendicular to the longitudinal axis of the clamping jaw. The opening to the groove is frustoconical so as to guide 3 the wire into the gripping dies. The grooves cooperate to clamp together and hold the wire when it is being head formed and cut by cutter dies 20. In the prior art such as U.S.

Pat. No. 5,979,216, the grooves have serrations therein for enhancing the ability of the gripping die to effectively hold the wire as it is being head formed and cut. Without such serrations, the wire would not be securely held and the wire would continue to progress and slip along the groove when it is being head formed and cut. The nails formed by this type of gripping tool results in axially spaced ridges along the length of the nail shank. The vast majority of penny and common nails currently being manufactured have these axially spaced ridges somewhere along the length of the nail.

Groove serrations create some drawbacks in manufacturing nails in comparison to a groove without any serrations. The wire has a greater propensity to stick to either one of the clamping jaws after the jaws are separated. The groove serrations in the prior art, upon penetration into the wire, occasionally would not release from the wire when the clamping gripping dies were separated but would stick to the die halting production resulting in undesirable downtime. It is believed that the wire is stuck to the groove due to the combination of friction and/or an interference deformation.

Figure 3:
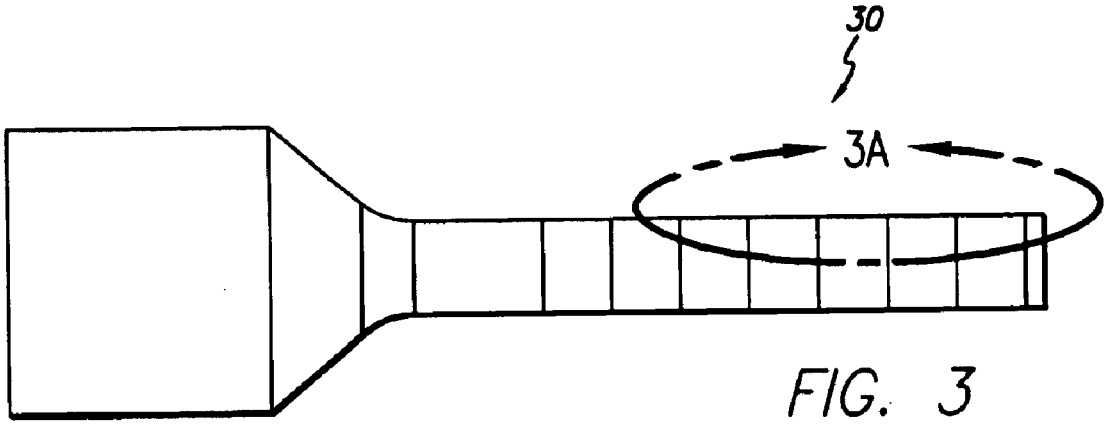
FIG. 3 illustrates the EDM die tool for forming the nail holding groove of the clamping insert.
Figure 4A:
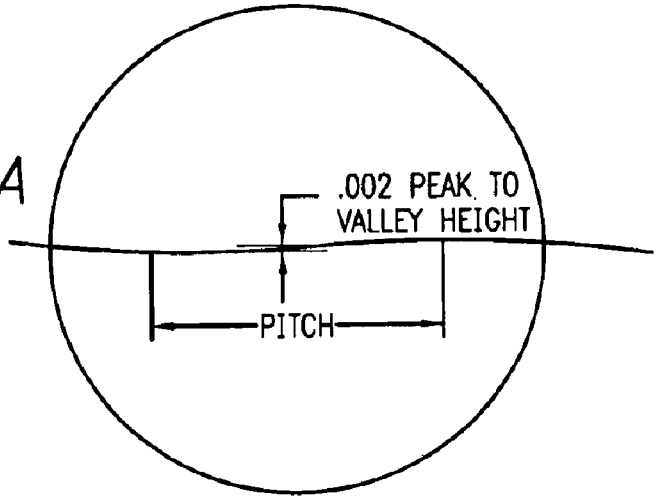
FIGS. 4–4A illustrates the shape of a nail shank formed by a sinusoidal wave clamping jaw.
Figure 4:
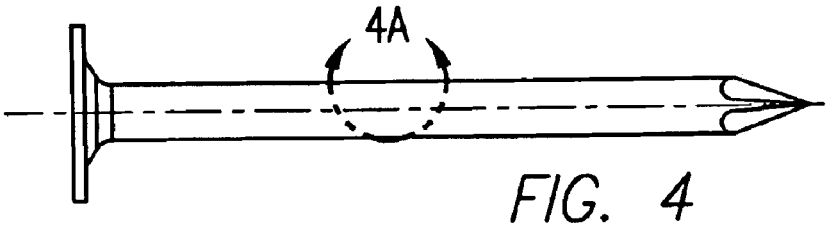

In the present invention, the diameter of the grooves 10 are not perfectly cylindrical but have smooth waves along their longitudinal axis. FIG. 3 illustrates an EDM die for forming the longitudinal groove in the hard clamping inserts 6. As seen in FIG. 3, uniform alternating concave and convex exterior surfaces are formed along the length of the EDM die tool. The radius of curvature for the concave and convex surfaces determined by the pitch and depth of the sinusoidal wave. The shorter the pitch (FIG. 4A), the smaller the radius of curvature of the concave and convex surfaces. The EDM tool is used to form a corresponding sinusoidal wave along the length of the groove of the carbide-clamping insert. The embodiments illustrated disclose a uniform sinusoidal wave, however the scope of the invention is not to be limited to a or exclusively a uniform sinusoidal wave. The invention also encompasses different variations of a smooth wave that can have nonuniform pitch, variations in amplitude between peaks of the same groove, and/or circumference al changes, such as a helical wave. A groove having a smoother exterior contour and substantially small deviations between the lowest valley and highest peak of the groove, 0.001–0.004 inches, provides for suitable alternative designs than that illustrated in the drawings.

When corresponding clamping jaw inserts 6 are in their clamping position, they do not contact each other but remain slightly separated to prevent wear and damage from contact. When the clamping jaws are actuated into the clamping position, a gap of generally 0.003–0.020 inches exists, preferably the gap is between 0.005–0.009 inches.

For instance, typically the resulting gap between clamping jaw inserts whenever the clamping jaws are in the clamping position may be 0.006 inches. When designing the groove used to make nails from a feed wire of a certain diameter, this gap must be taken into account. The nominal radius of the groove is calculated as follows:

½ D=R+0.003 inches

R—nominal radius of the groove,

D—diameter of feed wire;

The radial distance to the lowest point of each valley of the uniform sinusoidal wave formed in each groove is greater (deeper) than the radius of the wire less half the gap distance. The radial distance to the peaks of the sinusoidal wave in each groove is less than the radius of the wire less half the gap distance. The wire that is contacted during gripping by the peak of the groove is displaced into an adjoining valley of equal dimension when the jaws are clamped together. The nominal radius of the groove bisects the sinusoidal wave and bisects the valley and peak.

The wire forms the shank of the nail. The sinusoidal wave formed along the groove in comparison to a smooth clamping jaw enhances the grip of the wire during feeding and cutting operations. This sinusoidal wave is much less likely to cause attachment between the clamping insert groove and the wire as the serrated grooves of the prior art. It is believed that this is because the smooth sinusoidal wave is less likely to form a friction and interference deformation between the clamping insert groove and wire. As the gripping dies separate the smooth sinusoidal wave of the groove, it releases the wire without sticking or bonding. This clean release of the wire by the gripping dies reduces downtime and improves productivity.

Conventional steel clamping jaws without hard material clamping inserts, such as cemented tungsten carbide, last approximately 80 production hours before it becomes necessary to replace the jaw due to wear. Clamping jaws having tungsten carbide clamping inserts with a serrated groove last a much shorter time than a clamping insert having a sinusoidal wave groove. It is believed that the sharper edges of serrated grooves suffer from greater wear due to the nonuniform steep loads and forces that are applied to the tops of the serrated edges. Whereas, the loads and forces applied to the smooth sinusoidal wave are more uniformly distributed. The present wave groove's effective life expectancy is significantly longer than prior art serrated grooves. The ridge tips on the prior art serrated grooves result in load stress concentration and are more likely to fail.

The clamping insert is generally made from a hard wear-resistant material such as cemented tungsten carbide. For instance, a cemented tungsten carbide including 16% Cobalt can be used to construct clamping jaw inserts used to make nails from low carbon wire such as 1008 steel and 1010 steel, and cemented tungsten carbide including 25% cobalt and 5% tantalum carbide is suitable for gripping high carbon wire such as 1030 steel. Another suitable hard material that can be used to make the clamping jaw insert of the present invention is double cemented carbide as described in U.S. Pat. No. 5,880,382 to Fang et al, issued Mar. 9, 1999, which is hereby incorporated by reference in its entirety.

Figure 5:
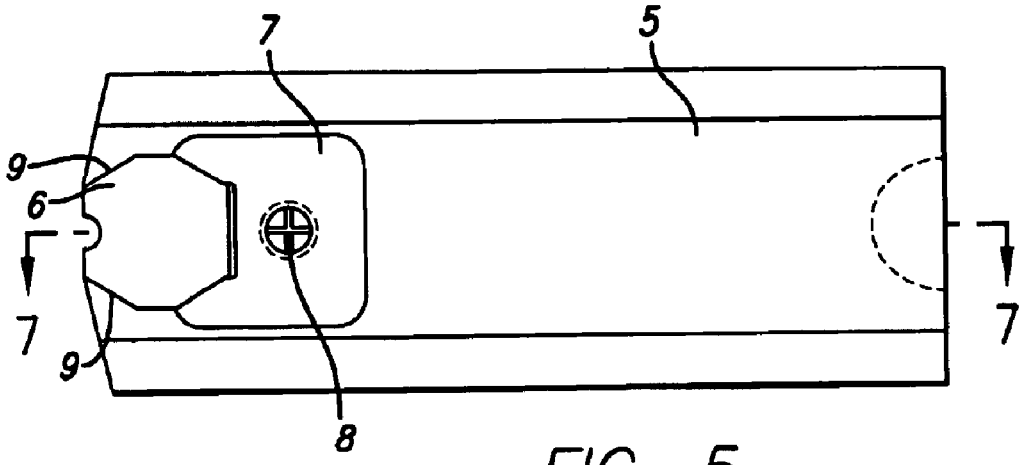
FIG. 5 illustrates an assembled clamping jaw.
Figure 6:
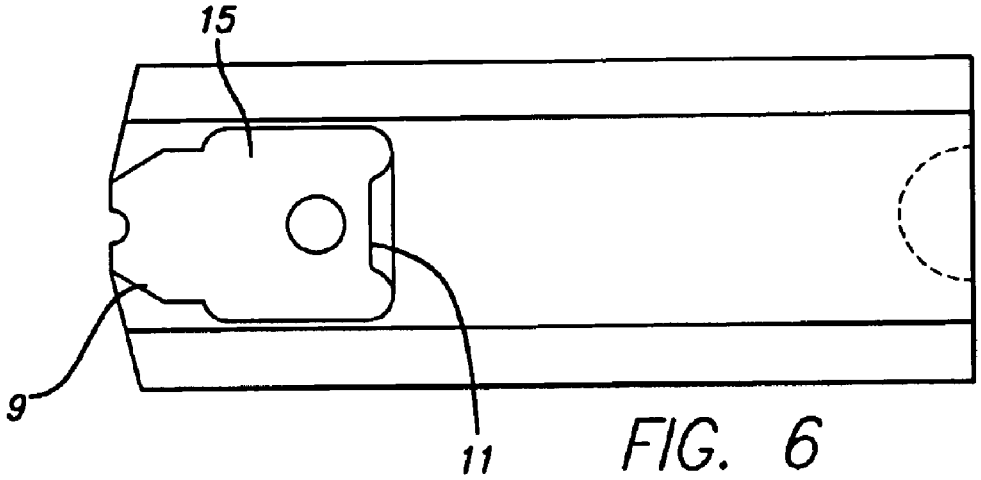
FIG. 6 illustrates the body of the clamping jaw assembly.
Figure 7:
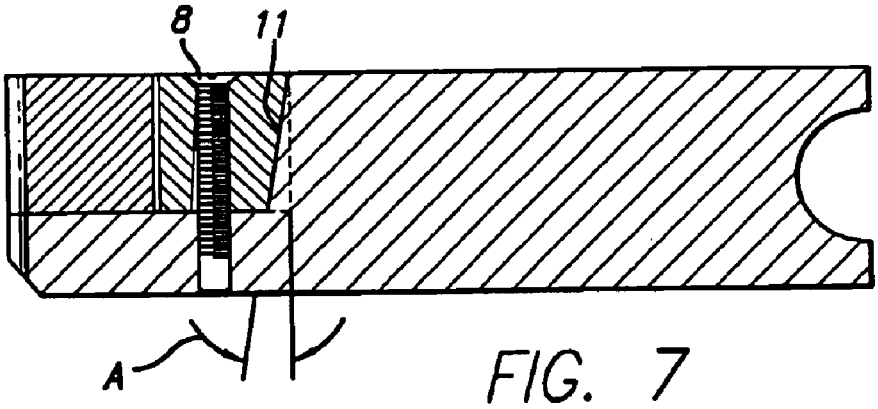
FIG. 7 illustrates a cross-section taken along lines 7—7 in FIG. 6.

FIG. 5 illustrates the clamping jaw assembly comprising a body 5, a wedge 7, and the hard-material clamping insert. The clamping insert 6 is wedged forward against a positive stop against the front side surface 9 of the cavity. The clamping insert is forced against the front side of the body by a wedge 7. The wedge is connected to the body by a fastening means 8 such as a screw, bolt or other equivalent fasteners. First, the octagonal clamping insert is set inside the front end of a forward cavity 15 in the body with the groove portion facing outward. The wedge is then placed in the rear end of the cavity. Next, a fastening means such as an screw 8 is inserted in the wedge and threaded into the housing. The diameter of the screw 8 positioned in the wedge bore 17 is smaller than the bore diameter. The relative size of these diameters allows for the transverse displacement of the wedge that occurs as the wedge is fastened by the screw onto the body.

As the screw is tightened, a sloped wedge backwall 11 of the cavity contacts a corresponding sloped wedge surface (16 shown as phantom line in FIG. 8) on the wedge 7. The cooperating wedge surface forces the clamping insert forward against the front side stop surface 9 of the body. The sloped backwall surface 11 is oriented at an angle A from the vertical. Angle A is approximately between 5–15 degrees and in one referred embodiment is 7 degrees.

Figure 8:
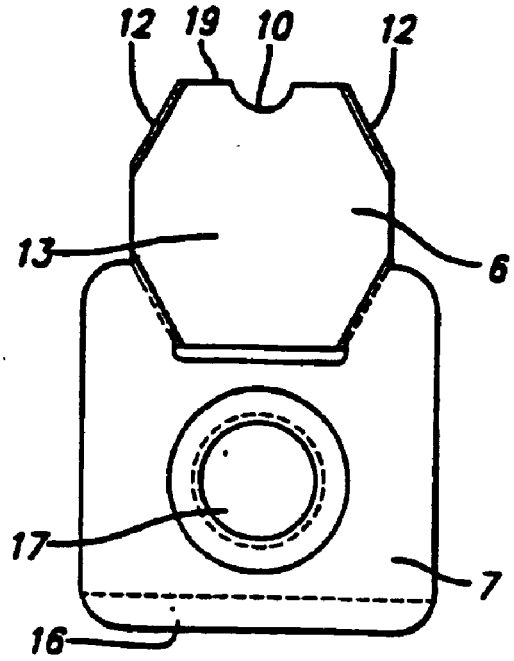
FIG. 8 illustrates the clamping member and clamping insert.

As shown in FIG. 8, the two octagonal sidewalls 12 adjacent to the groove 10 sidewall are not perpendicular with respect to the top face 13 and bottom face (not shown) of the clamping insert. The sidewall surfaces are tapered (towed) outward from the top surface to the bottom surface. The front side surface stop has a negative angle corresponding to the angle of the sidewalls 12. The cooperation between the siedwalls 12 and the negative angle of the front sidewall surface stop forces the clamping insert downward into the cavity as the wedge is screwed down.

In FIGS. 5–8, only one groove is shown on the clamping insert. It should be appreciated that a plurality of indexable grooves could be formed on each clamping insert. FIG. 2 illustrates a second groove identical to the first groove. The second groove is formed on the side opposite the side of the first. Accordingly, the two adjoining octagonal sidewall surfaces and front sidewall surface stop in this embodiment are also tapered (towed) at an angle with respect to the vertical B degrees outward from the top surface to the bottom surface. The angle of taper in either embodiment B can be between 1–5 degrees, an angle of 1 degree provides for satisfactory results.

This type of clamping jaw assembly permits carbide inserts to be changed or indexed without the need for removing the clamping body. Removal of the entire clamping body is necessary for designs, such as disclosed in European Patent 401,918B1. The side screw in European Patent 401,918B1 is not accessible when the clamping jaw is fixed to the motor drive and guide means during nail production. Replacement of clamping inserts in prior art designs, such as this, can take approximately twenty (20) minutes. The carbide clamping inserts of the present invention can be replaced in approximately five (5) minutes.

It should be noted that the above description of the embodiment illustrated in FIGS. 5–8 for attaching a clamping insert to a clamping jaw is only exemplary. Nor is the shape of the clamping insert limited to being octagonal with tapered (towed) sidewalls adjoining the groove sidewall. A hard-material clamping insert with a sinusoidal wave groove having a generally rectangular shape, as disclosed in European Patent 0401918B1 filed Jun. 5, 1990, is also contemplated in the present invention. Also, the hard material clamping insert with a sinusoidal wave groove could be designed to be cylindrical and employ clamping means as disclosed in European Patent Specification 0406202 B1, filed Jun. 26, 1990. The sinusoidal wave groove clamping insert could be designed a variety of different shapes and sizes to be used with different clamping means.

Figure 9:
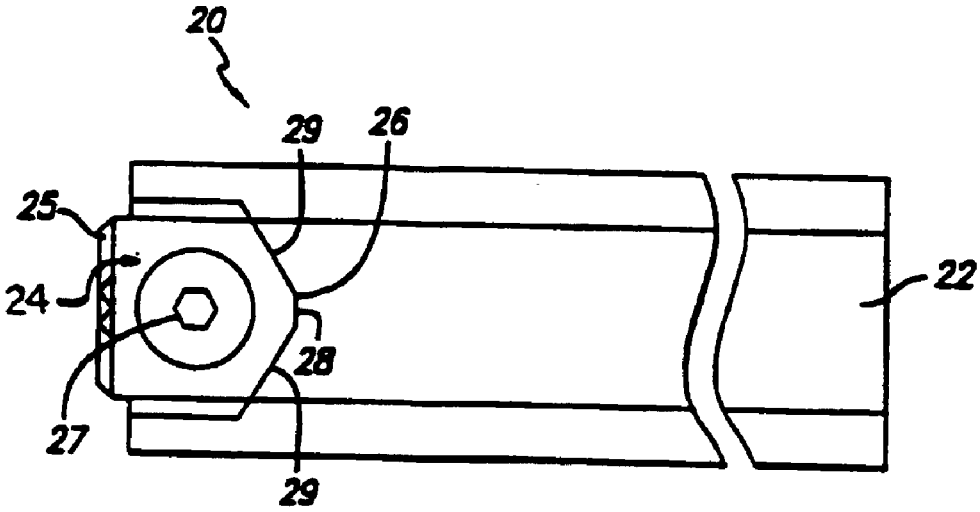
FIG. 9 illustrates a pincer jaw having a cutter insert.

FIG. 9 discloses an exemplary embodiment of nail cutter dies used in nail-making mechanism shown in FIG. 1. The nail cutter die includes a body 22 and a cutter insert 24. The cutter insert is positioned in a forward pocket of the body 22. The pentagonal pocket is symmetric along the longitudinal axis of the cutter body. The pocket has a general pentagonal house shape with a depth of approximately half the width of the body. The roof of the pentagonal house shape pocket forms an included angle of between 90–150 degrees. This roof end of the pocket functions as an acute locating angle for positioning and centering the cutting insert on the cutter. The cutter insert 24 is designed to have a corresponding identical "roof" angle (90–150 degrees) that cooperates with acute locating pocket angle to help locate and center the cutting insert into position.

The apex of the acute locating angle of the pocket is rounded 26 as well as the apex 28 of the roof of the cutter insert. The radius for curvature of the cutter insert 28 is larger than the apex radius of curvature 26 of the body pentagonal pocket. This dimensional relationship allows for the cutter insert to firmly seat against the planar roof sidewalls 29 of the pocket. The cutter insert is connected to the cutter body by a well-known offset locking screw 27 that positively draws the roof portion of the cutter insert into secure engagement with the acute locating pocket angle.

This arrangement results in an accurate and positive retention of the cutter insert. The acute and gel geometry prevents for the potential shifting of the inserts while under the cutting pressure of the machine as wire is continuously fed between two reciprocating cutters. The cutter illustrated in FIG. 9 is less likely than the indexed prior art rectangular insert designs to shift while under cutting pressure on account of its locating angle. Shifting and/or misalignment of the cutter insert results in catastrophic failure of the insert and the inability to properly point and separate the nail from the coil of wire. The lack of shifting allows for the cutting geometry to be maintained for a longer duration of time and extended production, minimizing downtime and providing a more cost efficient nail manufacturing machinery.

What is claimed is:

1. A nail cutter, used for manufacturing nails, is comprised of:

a cutter body; and a hard material cutter insert, wherein said cutter body includes a pentagonal pocket having an included locating angle for positioning and retaining said cutter insert in position.

2. The nail cutter, according to claim 1 is further comprised of: a fastening means for fixing the cutter insert to the cutter body.

3. The nail cutter, according to claim 2 wherein said cutter insert has an included locating angle for cooperating with said pocket including locating angle.

4. The nail cutter, according to claim 3 wherein said fastening means is an offset screw.

5. The nail cutter, according to claim 4 wherein the apex of said cutter insert included locating angle is rounded and said apex of included locating angle of said pocket is rounded.

6. The nail cutter, according to claim 5 wherein said rounded pocket apex has a radius of curvature smaller than said radius of curvature of said cutter insert so as to enable said cutter insert to firmly seat against said pocket.

7. The nail cutter, according to claim 1 wherein said included locating angle is between 90–150 degrees.

8. The nail cutter, according to claim 6 wherein said included locating angle is between 90–150 degrees.

* * * * *